US006435631B1

(12) United States Patent
Yee et al.

(10) Patent No.: US 6,435,631 B1
(45) Date of Patent: Aug. 20, 2002

(54) DECORATIVE TRIM FOR UNIT DOORS USED ON NEW MOTOR CONTROL CENTER

(75) Inventors: Edgar Yee, Chapel Hill; Martin Bankhead, Durham; Gilbert Soares; Harry Marvin, both of Mebane; Charles Piper, Burlington, all of NC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/474,511

(22) Filed: Dec. 29, 1999

(51) Int. Cl.[7] ..... A47B 17/04
(52) U.S. Cl. ..... 312/204; 312/223.2; 312/326
(58) Field of Search ..... 49/501; 40/657; 52/3, 27, 582.1, 578, 782.1, 718.05, 718.02; 361/616, 615, 607, 609; 200/50.01, 50.02; 312/223.1, 223.2, 234.1, 265.5, 265.6, 204, 326, 329, 292; 103/353, 408.1

(56) References Cited

U.S. PATENT DOCUMENTS 2,018,098 A * 10/1935 Sullivan
2,191,689 A * 2/1940 Tinnerman ..... 52/718.05 X
4,038,585 A * 7/1977 Wolski et al. ..... 200/50.01 X
5,362,933 A * 11/1994 Kutsche et al.
5,407,160 A * 4/1995 Hollingsworth et al.
5,424,911 A * 6/1995 Joyner et al. ..... 361/616
5,547,272 A * 8/1996 Paterson et al. ..... 312/223.2
5,630,632 A * 5/1997 Swan
5,986,211 A * 11/1999 Greer et al. ..... 361/616 X
6,088,219 A * 7/2000 Yanniello et al. .... 312/223.1 X

FOREIGN PATENT DOCUMENTS

GB 2255674 * 11/1992
GB 2262388 * 6/1993

* cited by examiner

*Primary Examiner*—Lanna Mai
*Assistant Examiner*—Hanh V. Tran
(74) *Attorney, Agent, or Firm*—Cantor Colburn LLP

(57) ABSTRACT

A decorative trim assembly for unit doors on a motor control unit. The decorative trim assembly comprises individual bezels that provide information about the motor control unit while distinguishing the motor control unit from other motor control units. Posts project from the back surfaces of the bezels and are received in holes in the unit doors. Retaining clips frictionally engage the posts and secure the bezels to the unit doors. Additional bezels are modularly connected to the secured bezel. The secured bezel contains a camouflaged cutout member that allows access to the unit door latch when removed. The unit door may be hingeably attached to the motor control unit along one edge of the unit door, and the unit door may contain quarter-turn latches along an opposing edge to secure the unit door to the motor control unit.

13 Claims, 11 Drawing Sheets

DECORATIVE TRIM FOR UNIT DOORS USED ON NEW MOTOR CONTROL CENTER

BACKGROUND OF THE INVENTION

The present invention relates generally to a decorative trim assembly for unit doors on a motor control system, and, more particularly, to bezels modularly connected to define the face layout on a unit door on a motor control system.

Trim bezels are typically used for concealing an opening between an electrical component and the panel in which it is mounted. They are usually decorative in appearance or contain indicia pertinent to the instrumentation of the system. For example, a bezel may be printed with the words "on" and "off" for use around a breaker, or it may indicate the name or some other identifying mark of the system on which it is installed. Bezels are usually installed directly to the panel or fascia using tabs, clips, screws, bolts, or a combination of these methods.

The major problem with some of the prior art bezels is that they often have to be custom made for the component interface around which they are mounted. Custom made bezels are generally more expensive than mass-produced bezels and sometimes add significantly to the costs of the finished product. Even if the bezels are not custom made, prior art bezels are usually of a standard shape and design that do not allow the past offerings of a product line to be easily differentiated from the current offerings of the same product line.

Moreover, in designing the face layout and assembling an electrical panel, individual trim pieces are separately attached to the surface of the unit door. The installation of additional instrumentation also requires the installation of an additional bezel. In the prior art, adding bezels would require attaching each individual bezel using screws. Typically, these screws would be installed from the back of the instrument panel. The use of a screw as a means of attaching and securing each individual bezel, along with having to open an electrical box to install the screw from the back of the door of the electrical box, increases the costs involved with assembling the finished product.

SUMMARY OF THE INVENTION

In an exemplary embodiment of the invention, a decorative trim assembly for unit doors on a motor control center defines the individual components situated on the unit doors. Bezels are mounted to the door around components such as meters and switches. The bezels are modularly connected using bushings and receiving holes in each bezel, and are secured to the unit door with posts integrally mounted on the back sides of each bezel and retaining clips. In one alternate embodiment, mounting screws and tabs that slidably engage slots in the unit door may be used to secure each bezel to the unit door. A lip may be attached or molded into at least one edge of the bezel to allow the bezel to be easily grasped while being removed or pulled away from the unit door. The pilot device bezel may also contain a removable cutout member that allows access to a hidden door latch. The inventive decorative trim bezels may be attached to a unit door that is hingeably attached to the motor control center and contains quarter-turn latches that allow the door to be secured to the motor control center while still allowing access to the internal components of the motor control center.

The modularity of the inventive design allows for the manufacture and assembly of only a few different pieces, thus minimizing the unique part count. Furthermore, the modular assembly approach allows many different pieces to be combined to accommodate the configurations of standard height motor control units as well as the configurations of extended height motor control units.

DETAILED DESCRIPTION OF THE INVENTION

Figure 1:
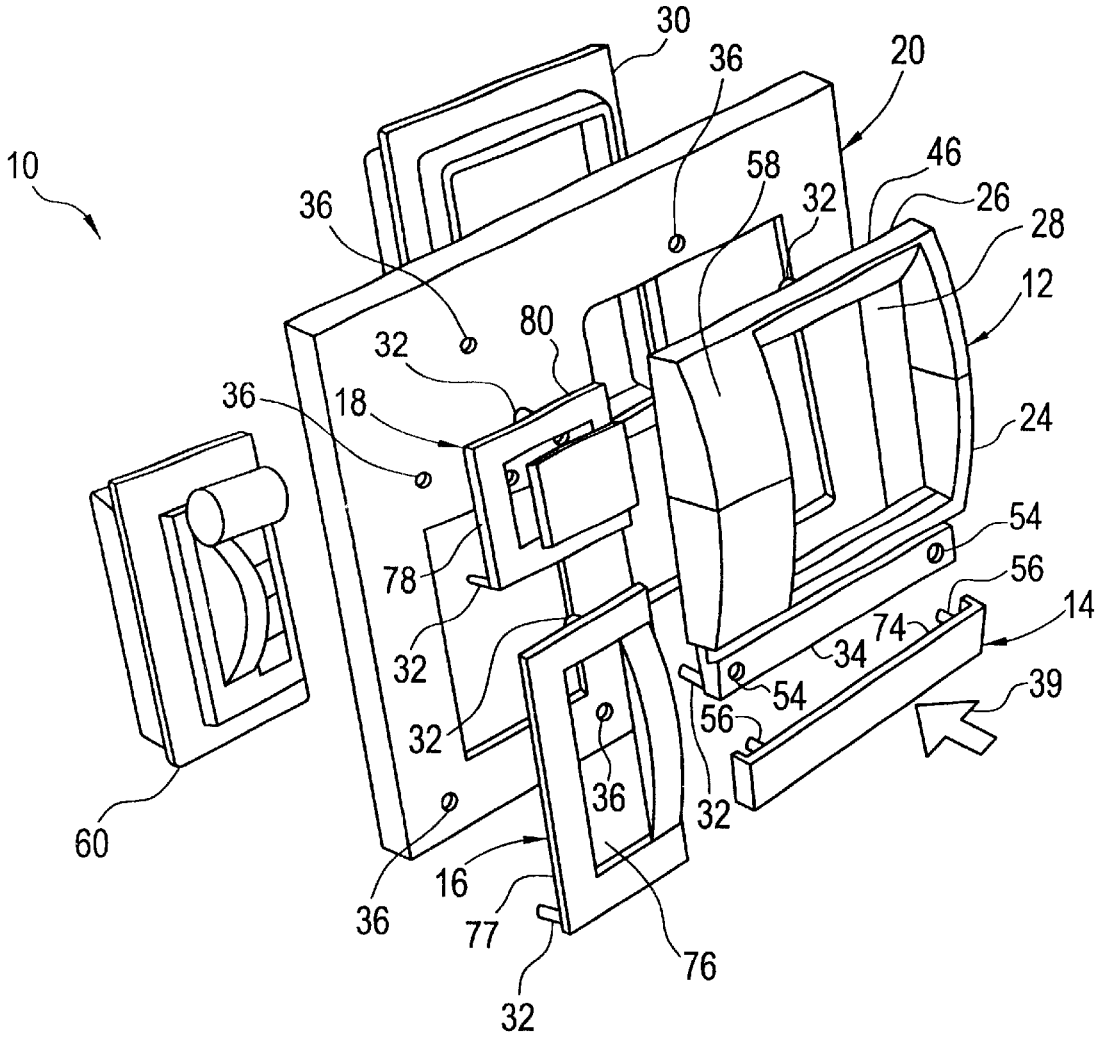
FIG. 1 is an exploded perspective view of the decorative trim pieces, of the present invention, being positioned on the front of a unit door.
Figure 2:
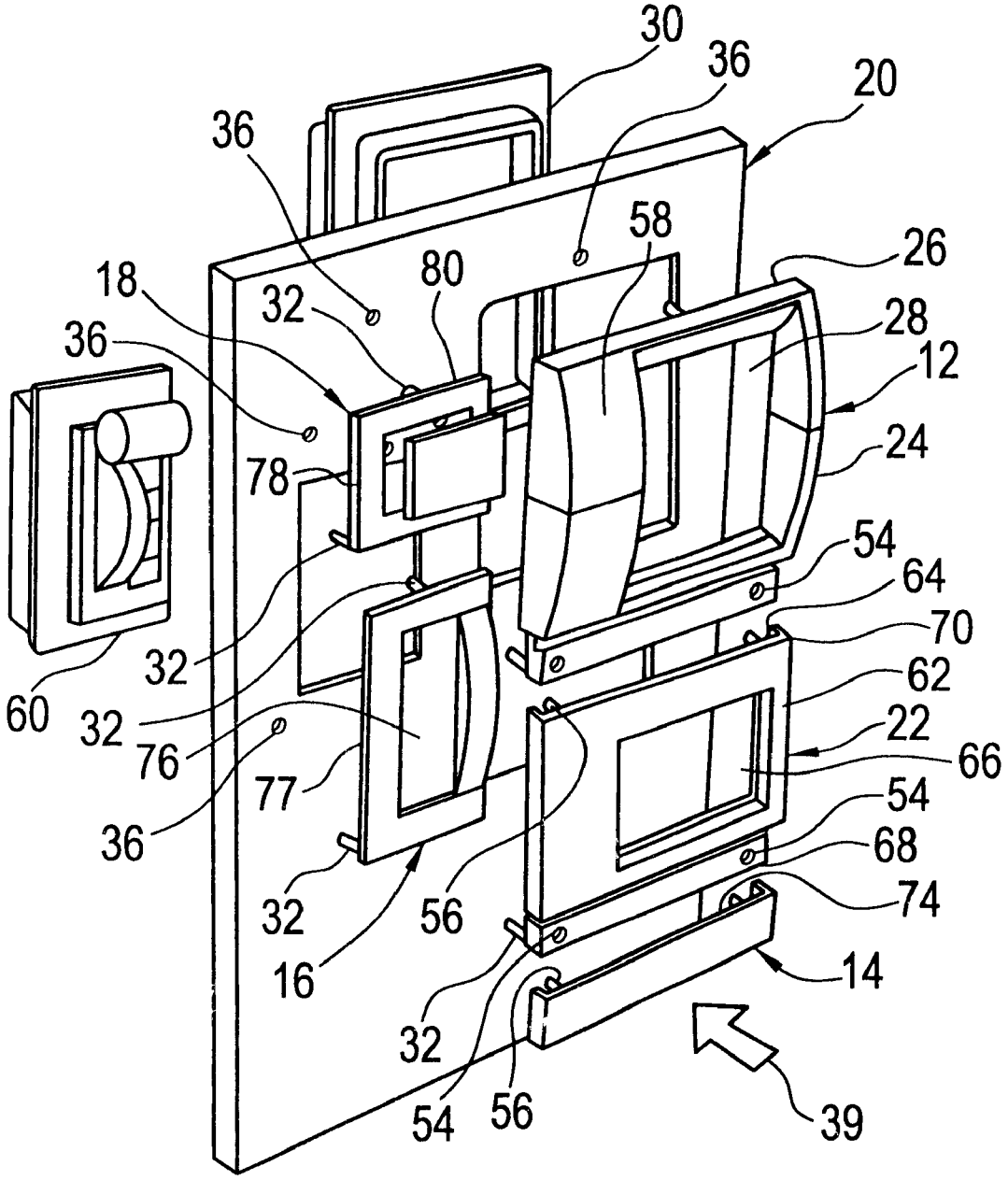
FIG. 2 is an exploded perspective-view of the decorative trim pieces, of the present invention, with an additional embodiment, of the present invention, being positioned on the front of the unit door.

Referring to FIG. 1, a decorative trim assembly, which can also be referred to as a decorative trim molding, of an exemplary embodiment of the present invention is shown generally at 10. Decorative trim assembly 10 includes a pilot device bezel 12, a bezel cover 14, a breaker bezel 16, and a name plate 18, all of which are situated on a unit door 20 of a motor control center. An alternate embodiment of decorative trim assembly 10, as shown in FIG. 2, contains a bezel extension frame 22. Pilot device bezel 12 is shown in FIGS. 1 and 2 as being generally rectangular in shape and having a front side 24 which faces away from unit door 20, a back side 26 which faces and engages unit door 20, and a central opening 28 which is slightly smaller than a face of an instrument interface 30 over which pilot device bezel 12 is mounted.

Figure 3:
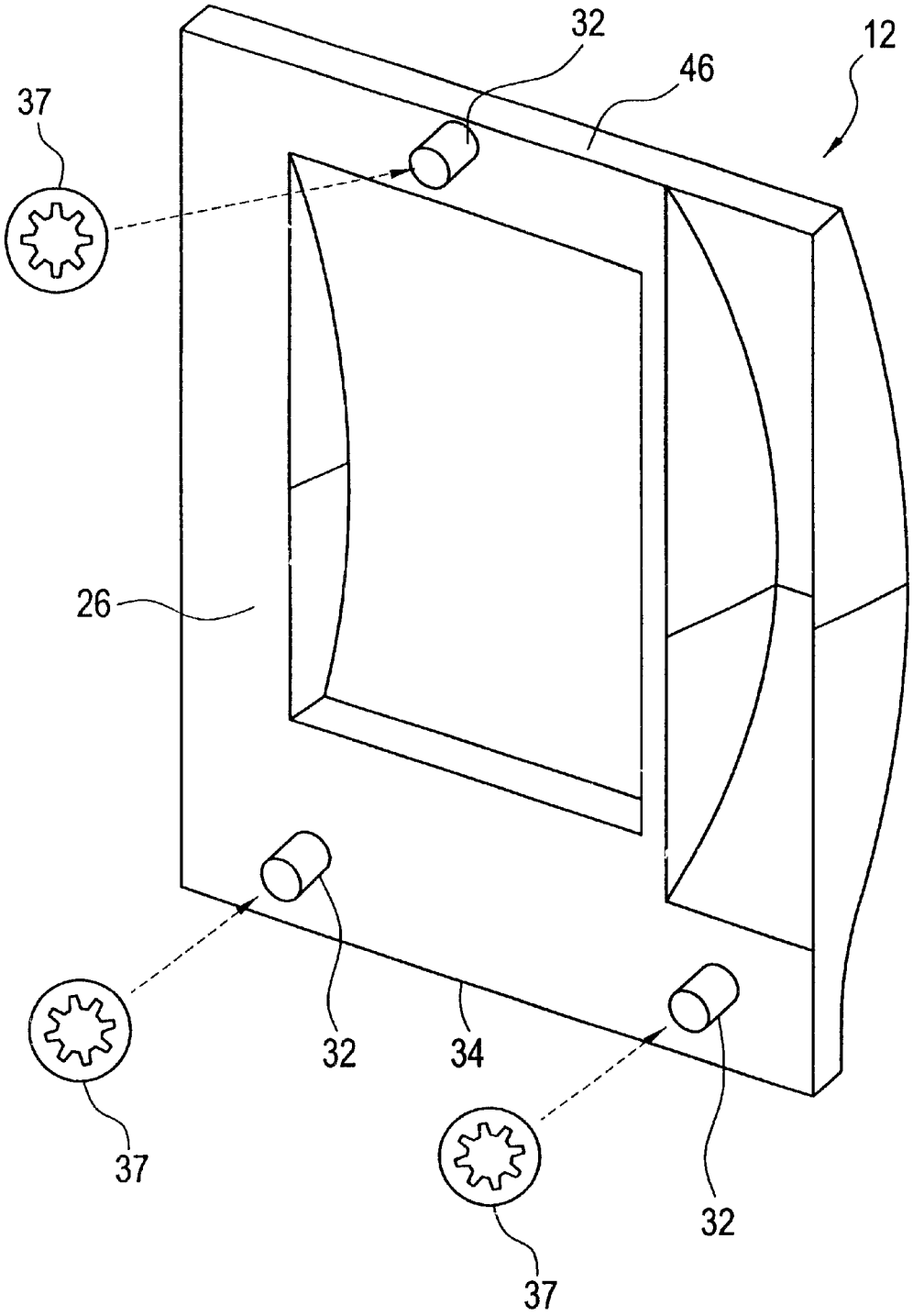
FIG. 3 is a perspective view of a back side of a pilot device bezel, of the present invention, showing a detailed view of a post and a retaining clip.

Referring to FIG. 3, a means for securing pilot device bezel 12 to unit door 20 is illustrated. At least one post 32 is attached to back side 26 of pilot device bezel 12 proximate a first edge 34 of pilot device bezel 12, and is configured and dimensioned to be received in a corresponding number of post holes 36. At least one post 32 is positioned proximate a second edge 46 of pilot device bezel 12 and is likewise configured and dimensioned to be received in a corresponding number of post holes 36. Retaining clips 37 are inserted over the portion of posts 32 received through post holes 36 and are dimensioned to be frictionally retained on posts 32 thus securing pilot device bezel 12 to unit door 20.

Figure 4:
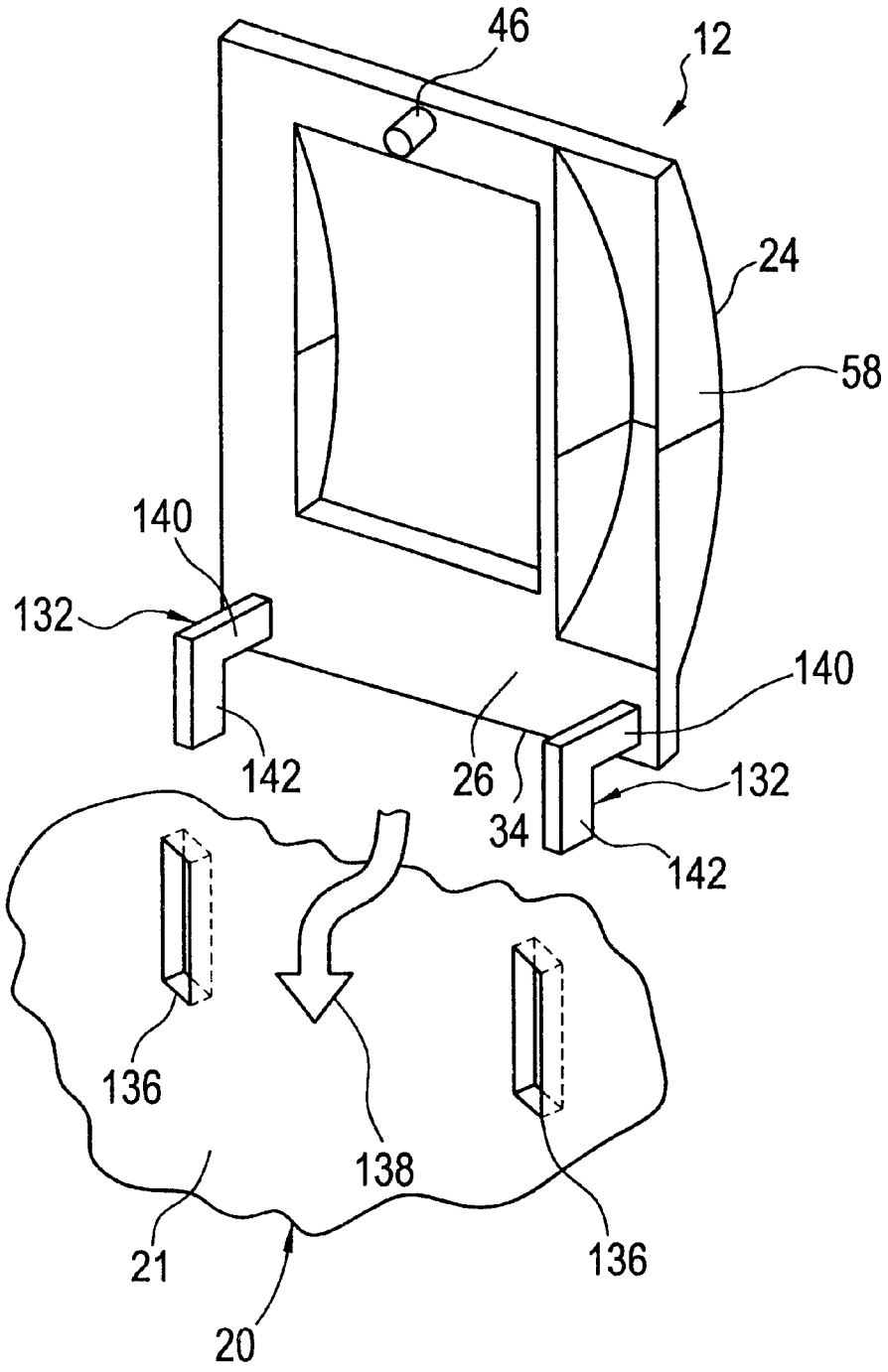
FIG. 4 is a perspective view of a back side of an alternate embodiment, of the present invention, showing a detailed view of a tab.

In FIG. 4, an alternate embodiment of the invention is shown in which a tab 132 is used to retain pilot device bezel 12 on unit door 20. Tab 132 is an L-shaped structure wherein a first leg 140 projects from back side 26 while a second leg 142 is received in a slot 136. Second leg 142 extends along a longitudinal axis of slot 136 to engage an interior surface 21 of unit door 20, thus allowing tab 132 to be retained in slot 136 when pilot device bezel 12 is moved in the direction of arrow 138.

Figure 5:
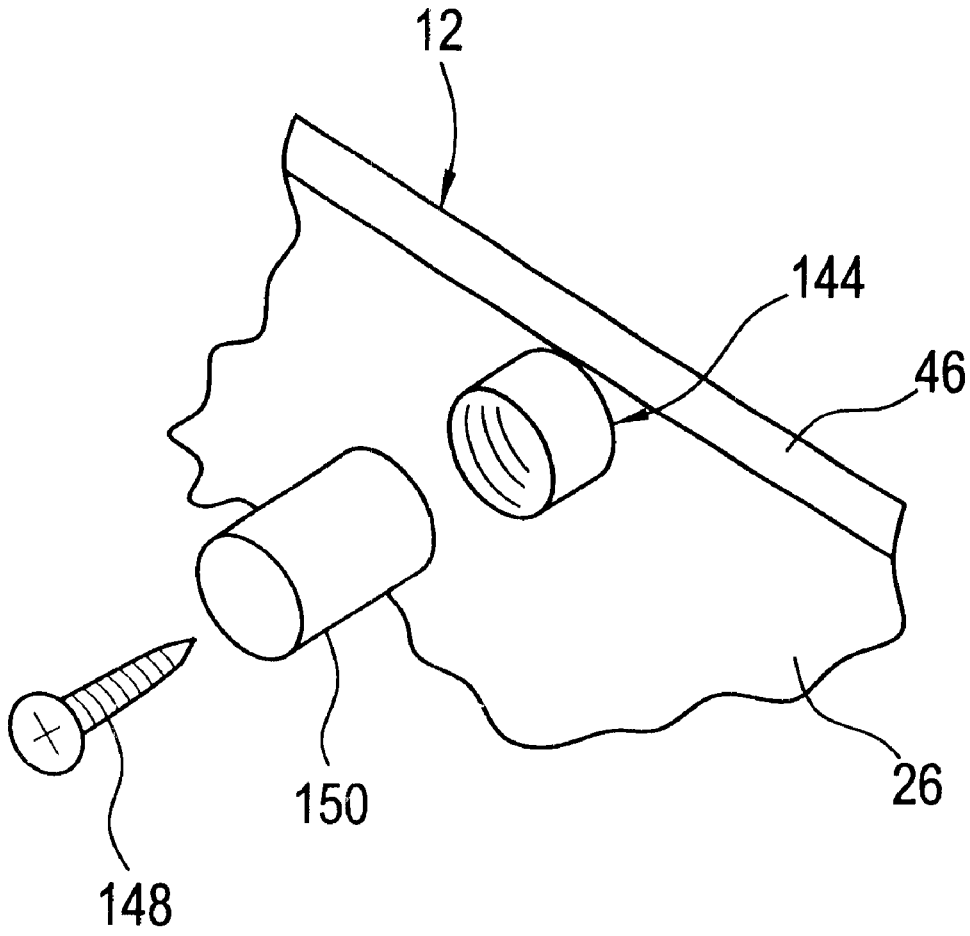
FIG. 5 is a perspective view of the mounting hole on the back side of the pilot device bezel, of the present invention.

Turning now to FIG. 5, in the above-mentioned alternate embodiment, a mounting hole 144 may be used to further secure pilot device bezel 12 to unit door 20. Mounting hole 144, used in conjunction with tabs 132, is shown integrally formed proximate second edge 46 of back side 26 of pilot device bezel 12. Mounting hole 144 may be configured to threadedly receive a mounting screw 148 inserted from the interior surface (not shown) of unit door 20. A mounting washer 150 may be positioned between the head of mounting screw 148 and mounting hole 144 and should be of sufficient size to keep the head of mounting screw 148 from passing through a screw hole (not shown) in unit door 20.

Referring back to FIGS. 1 and 2, receiving holes 54 are situated along first edge 34 on front side 24 of pilot device bezel 12. Receiving holes 54 are dimensioned and configured to snappingly receive bushings 56 integrally formed on bezel extension frame 22 and bezel cover 14 which connect bezel extension frame 22 or bezel cover 14 to pilot device bezel 12. Bushings 56 are described in greater detail below with reference to FIG. 8.

Front side 24 of pilot device bezel 12 also contains a camouflaged cutout member 58. Camouflaged cutout member 58 is snappingly attached to pilot device bezel 12 and is concavely oriented relative to the outer surface of unit door 20 to conceal a latching mechanism (not shown). Removal of camouflaged cutout member 58 allows access to the latching mechanism thus enabling unit door 20 to be opened without turning off a circuit breaker switch 60.

Figure 6:
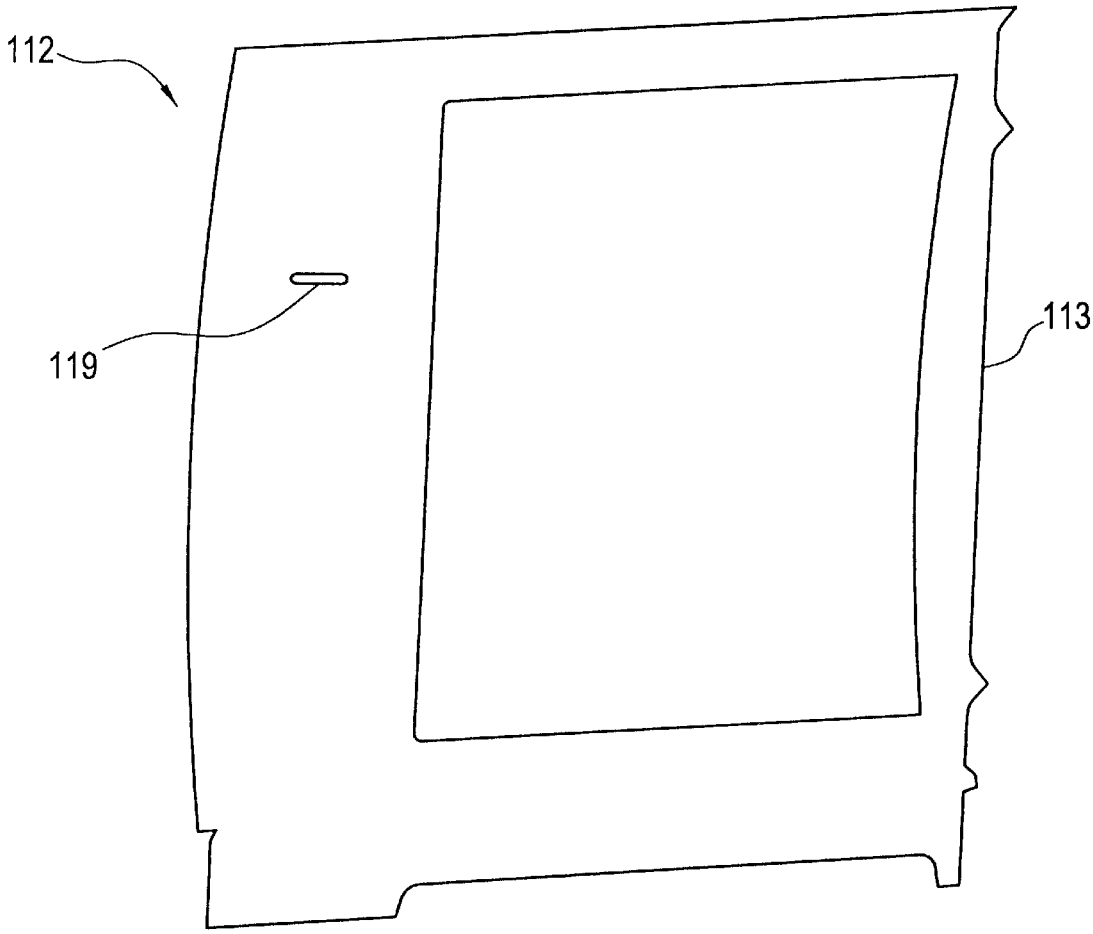
FIG. 6 is a perspective view of the front side of an alternate embodiment of the pilot device bezel, of the present invention, showing a door defeater access hole and a pull lip.
Figure 7:
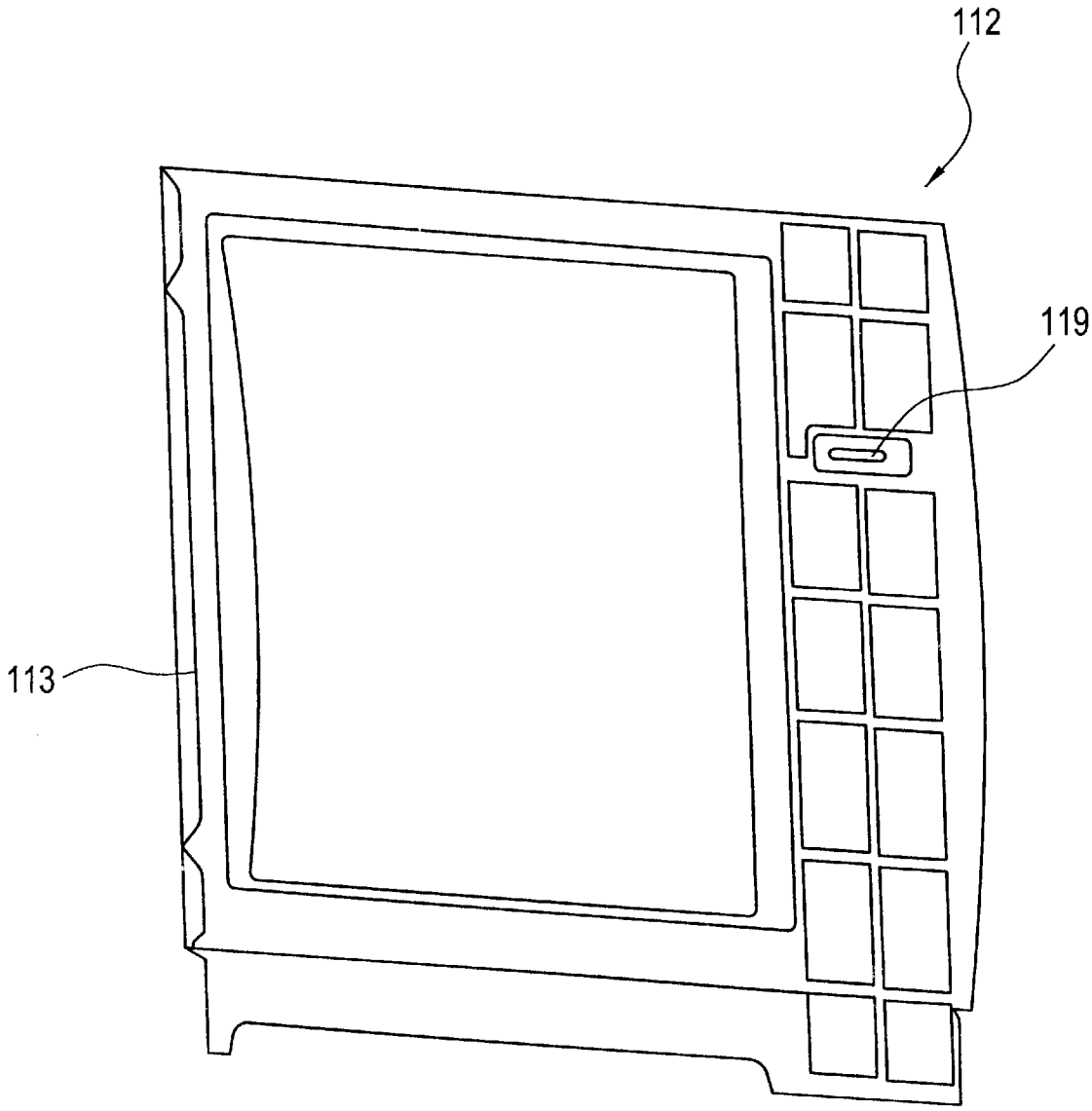
FIG. 7 is a perspective view of the back side of the alternate embodiment of the pilot device bezel, of the present invention, showing the door defeater access hole and the pull lip.

Referring now to FIGS. 6 and 7, another embodiment of the pilot device bezel is shown generally at 112. Pilot device bezel 112 attaches to unit door 20 in a conventional manner, such as via hinged elements (not shown) disposed along one edge of the flat planar member of the molding; however, pilot device bezel 112 contains a lip 113 defining a "finger grab" area along an edge opposing the edge on which the hinged elements are disposed. Lip 113 allows a person to grasp the edge of pilot device bezel 112 and pull pilot device bezel 112 away from the face of unit door 20. Also shown is an access hole 119, which allows the latching mechanism on unit door 20 to be accessed and defeated, thereby enabling unit door 20 to be opened when the circuit breaker switch (not shown) is in the "on" position.

Referring back to FIG. 2, bezel extension frame 22 is shown as a rectangular frame similar in structure to pilot device bezel 12 and having a front side 62 which faces away from unit door 20, a back side 64 which faces and engages unit door 20, and a central opening 66 which is slightly smaller than the face of instrument interface 30 around which bezel extension frame 22 is mounted. Bezel extension frame 22 contains at least one post 32 attached to back side 64 of bezel extension frame 22 proximate a first edge 68 of bezel extension frame 22. Post 32 is configured and positioned in a fashion similar to that of pilot device bezel 12 and assists in retaining bezel extension frame 22 on unit door 20 when bezel extension frame 22 is mounted to unit door 20 in a manner similar to the mounting of pilot device bezel 12. Receiving holes 54 similar to those on pilot device bezel 12 for receiving bushings 56 are situated on front side 62 along first edge 68 of bezel extension frame 22.

Figure 8:
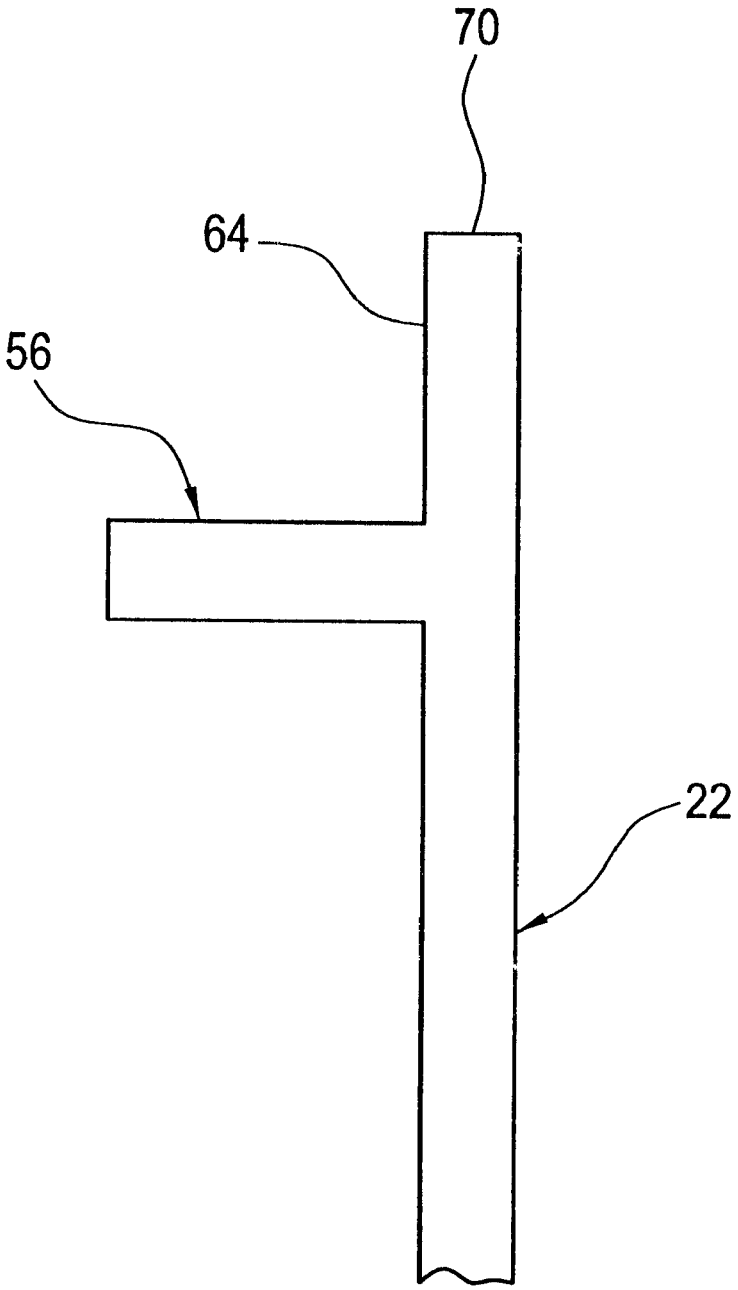
FIG. 8 is a side elevated view of a bushing integrally formed on the bezel extension frame, of the present invention.

Referring now to FIG. 8, bushing 56 is shown in greater detail. At least one bushing 56 is integrally formed on a second edge 70 of back side 64 of bezel extension frame 22. Bushing 56 projects cylindrically from back side 64 of extension frame bezel 22 and is of a sufficient axial length to be snappingly received in receiving holes 54 disposed in pilot device bezel 12 or another extension frame bezel 22. The combination of posts 32 received in post holes 36 and bushings 56 snappingly received in receiving holes 54 of pilot device bezel 12 or another extension frame bezel 22 secure bezel extension frame 22 to unit door 20. Because of the combination of receiving holes 54 and bushings 56 on each bezel extension frame 22, a plurality of bezel extension frames 22 can be modularly connected to each other.

Referring back to FIGS. 1 and 2, bezel cover 14 is shown as a flat planar member securable to pilot device bezel 12 or extension frame 22 in order to hide receiving holes 54 in pilot device bezel 12 or extension frame 22 and to give a pleasing appearance to pilot device bezel 12 or extension frame 22. Bezel cover 14 has bushings 56 extending normal to a back side 74 of bezel cover 14 which are of a sufficient axial length to be snappingly received in a corresponding number of receiving holes 54 in pilot device bezel 12 or extension frame 22. Bezel cover 14 is "snapped into" receiving holes 54 by aligning bushings 56 with receiving holes 54 and moving bezel cover 14 in the direction of an arrow 39.

Still referring to FIGS. 1 and 2, breaker bezel 16 is shown as being generally rectangular in shape and having a central opening 76 that receives and accommodates breaker switch 60. Breaker bezel 16 is configured similarly to pilot device bezel 12. For example, breaker bezel 16 contains at least one post 32 on a back side 77 of breaker bezel 16 to be received in post holes 36 in unit door 20 and retaining clips 37 used to retain posts 32 in post holes 36. Posts 32 received in post holes 36 enable breaker bezel 16 to be secured to unit door 20 in a manner similar to that of pilot device bezel 12.

Figure 9:
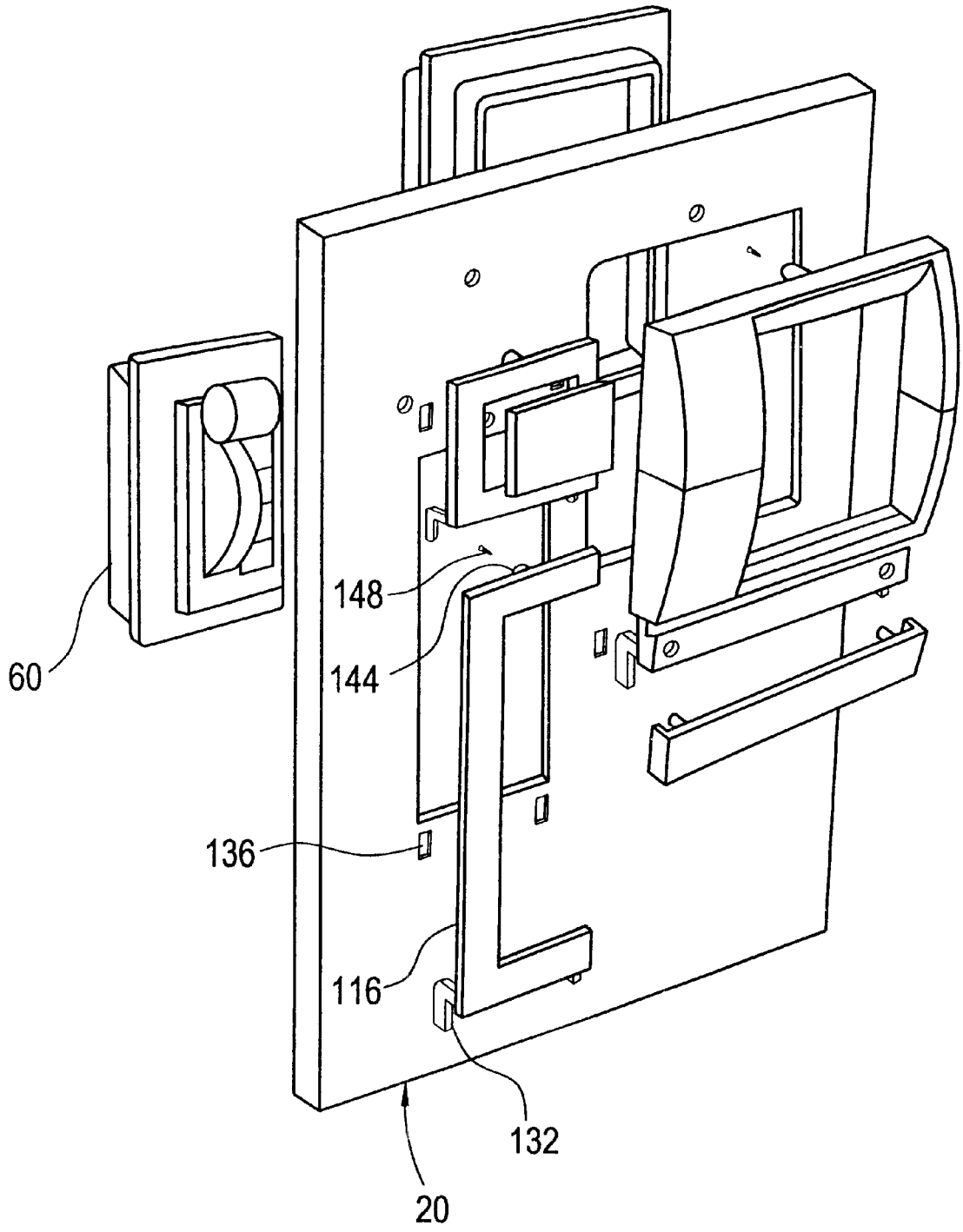
FIG. 9 is a perspective view of an alternate embodiment of the breaker bezel, of the present invention, being positioned on the front of the unit door.

An alternate embodiment of breaker bezel 16 is shown in FIG. 9 generally at 116. In the interest of saving space on the front of unit door 20, if a hole through which breaker switch 60 is positioned is too proximate any other device mounted on unit door 20, part of breaker bezel 16 can be removed leaving breaker bezel with only three sides. The missing fourth side of breaker bezel 16 is then positioned adjacent the proximately-situated device on unit door 20. Posts 32 still engage post holes 36 to retain breaker bezel 116 on unit door 20.

Again referring to FIGS. 1 and 2 show name plate 18 as being structured similarly to pilot device bezel 12 and breaker bezel 16. Name plate 18 is generally rectangular in shape and has a front side 78 which faces away from unit door 20, a back side 80 which faces unit door 20, and at least one post 32 configured and positioned in a fashion similar to that of pilot device bezel 12 and bezel extension frame 22 integrally formed on back side 80 of name plate 18. Front side 78 is generally planar and has a flat surface on which can be printed or embossed a logo, name, or some other defining characteristic of the motor control center. Post 32 received in post hole 36 allows name plate 18 to be secured to unit door 20 in a manner similar to that of pilot device bezel 12 and breaker bezel 16.

Figure 10:
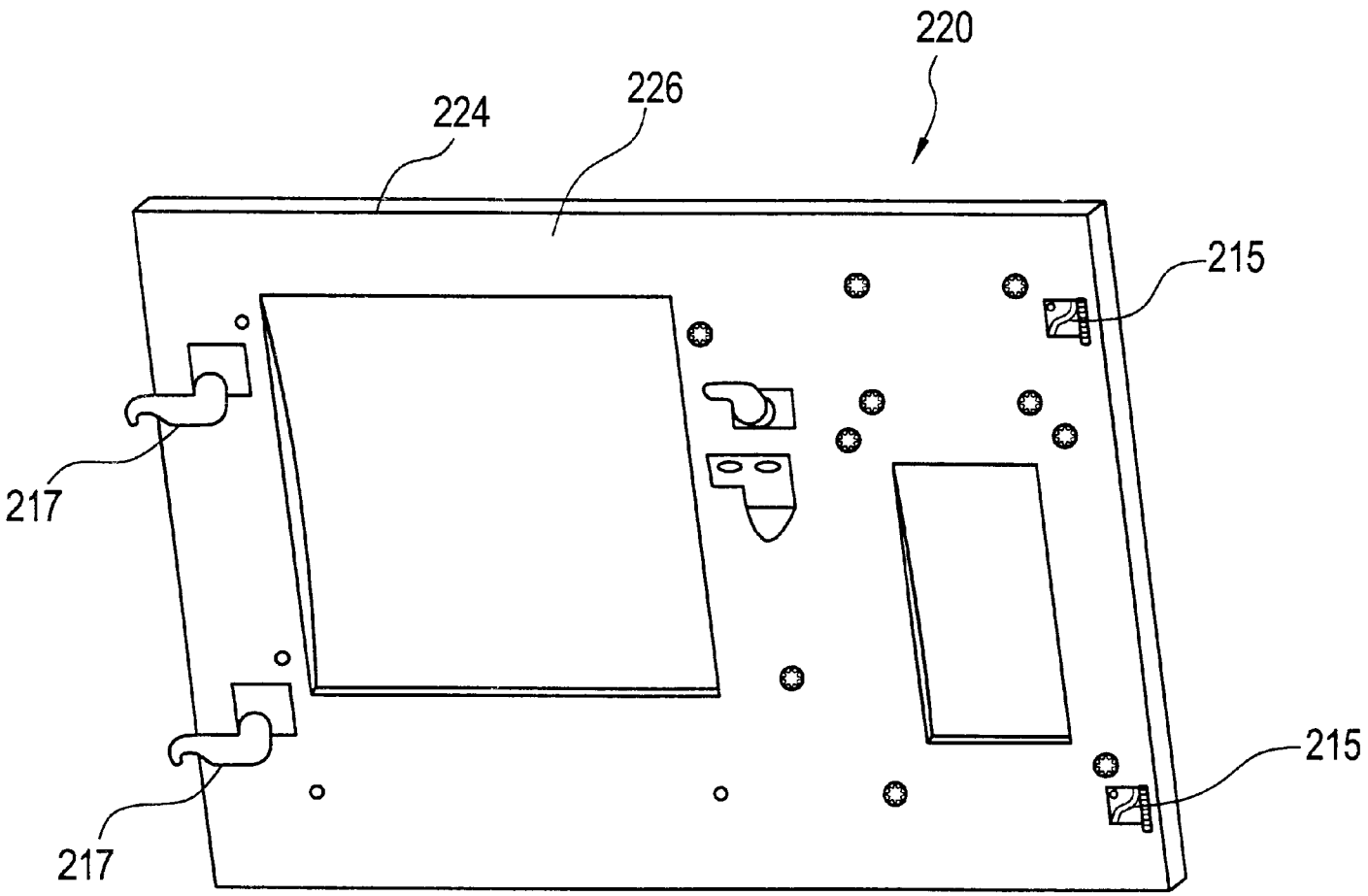
FIG. 10 is a perspective view of the back side of a unit door, of the present invention, having hinges positioned along one side for hingedly attaching the unit door to a motor control center, and showing quarter turn latches for securing an opposing side of the unit door to the motor control center.
Figure 11:
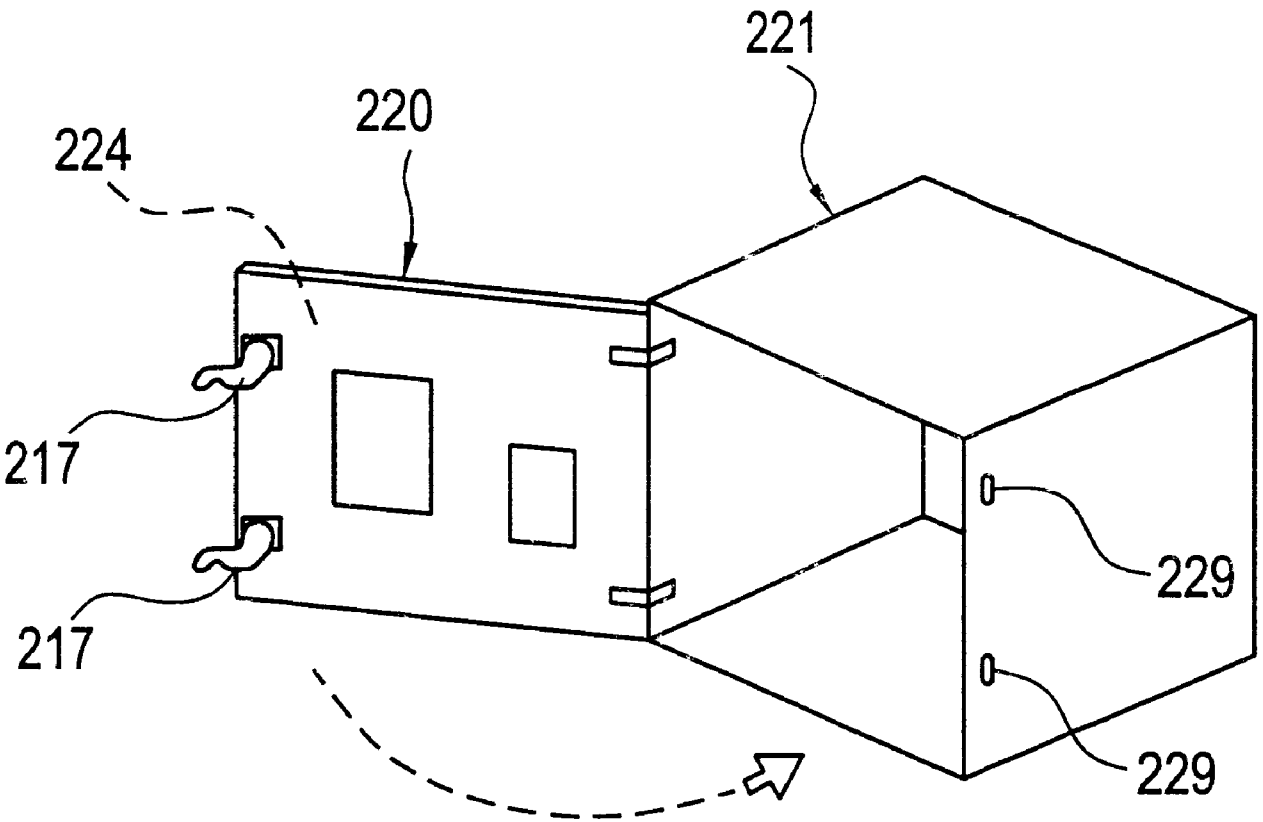
FIG. 11 is a perspective view of a unit door hingedly attached to a motor control center.

Referring now to FIGS. 10 and 11, a unit door is shown generally at 220. Unit door 220 is attached along one edge utilizing hinges 215 to a motor control center shown at 221 in FIG. 11, thereby causing unit door 220 to swing away from motor control center 221 when an edge opposing the hinged edge is not secured to motor control center 221. Also shown in FIGS. 10 and 11 are quarter turn latches 217 positioned along the unhinged edge of unit door 220 on a back side 226 of unit door 220. Quarter turn latches 217 are configured to be accessed from a front side 224 of unit door 220 using a screwdriver or similar tool (not shown). In a closed position, quarter turn latches 217 are received in slot openings shown at 229 in FIG. 11 and cause unit door 220 to be retained against motor control center 221. Accessing and rotating quarter turn latches 217 from front side 224 of unit door 220 causes quarter turn latches 217 to rotate out of slot openings 229 allowing unit door 220 to swing freely away from motor control center 221.

While this invention has been described with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the appended claims.

What is claimed is:

1. A decorative trim molding securable to a unit door, said decorative trim molding comprising a flat planar member having a cutout member removably attached to a front surface of said decorative trim molding, said cutout member being configured to allow access through said decorative trim molding upon removal of said cutout member.

2. The decorative trim molding of claim 1 wherein said cutout member is hingeably attached to said flat planar member.

3. A unit door hingeably attachable to a motor control center, said unit door comprising:

a generally planar member having at least one hinge fixedly attached to an edge of said planar member, said at least one hinge being connectable to said motor control center;

a first trim molding including, means for attaching a first side of said first trim molding to said door; and a second trim molding including, means for attaching a first side of said second trim molding to a second side of said first trim molding.

4. A decorative trim molding securable to a unit door, said decorative trim molding comprising:

a generally planar member comprising, a central opening positioned on said generally planar member and extending through said generally planar member, and a cutout member removably attached to a front surface of said generally planar member, said cutout member being configured to allow access through said decorative trim molding.

5. The decorative trim molding of claim 4 wherein said decorative trim molding has at least one post on a back surface of said planar member, said at least one post being receivable in a hole in said unit door, and said at least one post being configured and positioned to be engaged by a retaining clip received on said post, said retaining clip frictionally retaining said post in said retaining clip and securing said decorative trim molding to said unit door.

6. An attachment system for securing a decorative trim molding to a unit door, said attachment system comprising: a post positionable on a back surface of said decorative trim molding, said post configured and positioned to be receivable by a hole in said unit door, and said post configured and positioned to be engaged by a retaining clip received on said post, said retaining clip frictionally retaining said post in said retaining clip and thereby causing said decorative trim molding to be securable to said unit door, and said decorative trim molding having a raised lip along an edge thereof, thereby allowing said decorative trim molding to be securely grasped to open said unit door.

7. The attachment system of claim 6 wherein said decorative trim molding includes a central opening extending completely through said decorative trim molding.

8. The attachment system of claim 6 wherein said decorative trim molding is an identification plate.

9. The attachment system of claim 6 wherein said attachment system comprises at least one tab disposed on a back side of said decorative trim molding, said at least one tab configured and positioned to be receivable in a slot in said unit door.

10. A motor control center, comprising:

a unit door disposed on a frame of said motor control center, said unit door having a hole disposed therein;

a first trim molding configured to be attachable to said door, said first trim molding having a bushing protruding from a first surface thereof and a hole disposed in an opposing second surface thereof, said bushing being configured to be snappingly received in said hole disposed in said unit door; and a second trim molding configured to be attachable to said first trim molding, said second trim molding having a bushing protruding therefrom, said bushing being configured to be snappingly received in said hole disposed in said opposing second surface of said first trim molding.

11. A motor control center, comprising:

a unit door disposed on a frame of said motor control center, said unit door having a hole disposed therein;

a first trim molding configured to be attachable to said door, said first trim molding having a bushing protruding from a first surface thereof and a hole disposed in an opposing second surface thereof, said bushing being configured to be snappingly received in said hole disposed in said unit door; and wherein said first trim molding includes a lip defined thereon, said lip being configured to provide a surface at which said unit door can be grasped to facilitate the opening of said unit door.

12. A motor control center, comprising:

a unit door disposed on a frame of said motor control center, said unit door having a hole disposed therein;

a first trim molding configured to be attachable to said door, said first trim molding having a bushing protruding from a first surface thereof and a hole disposed in an opposing second surface thereof, said bushing being configured to be snappingly received in said hole disposed in said unit door; and wherein said first trim molding includes a central opening disposed therein, said central opening being dimensioned to allow access to an instrument interface therethrough.

13. A motor control center, comprising:

a door;

a first trim molding configured to be attachable to said door, said first trim molding having a first side and a second side, said first trim molding comprising, means for attaching said first side of said first trim molding to said door, and a second trim molding configured to be attachable to said first trim molding, said second trim molding having a first side and a second side, said second trim molding comprising, means for attaching said first side of said second trim molding to said first trim molding.

* * * * *